United States Patent [19]

Boudreau

[11] Patent Number: 4,544,179

[45] Date of Patent: Oct. 1, 1985

[54] CLIMBING DEVICE FOR SKIS

[76] Inventor: Clarence Boudreau, General Delivery, Penny, British Columbia, Canada, V0J 2K0

[21] Appl. No.: 540,168

[22] Filed: Oct. 7, 1983

[51] Int. Cl.[4] ..... A63C 7/08

[52] U.S. Cl. ..... 280/604; 280/809; 188/8

[58] Field of Search ..... 280/604, 809, 605; 188/8

[56] References Cited

U.S. PATENT DOCUMENTS

| | | | |
|---|---|---|---|
| 2,358,213 | 9/1944 | Courage | 280/604 |
| 4,002,349 | 1/1977 | Dopp | 280/814 |
| 4,231,584 | 11/1980 | Kikuchi | 280/604 |

FOREIGN PATENT DOCUMENTS

| | | | |
|---|---|---|---|
| 904632 | 11/1945 | France | 280/604 |
| 2401674 | 4/1979 | France | 280/604 |

*Primary Examiner*—David M. Mitchell
*Assistant Examiner*—Richard Camby
*Attorney, Agent, or Firm*—Carver & Co.

[57] ABSTRACT

A climbing device for skis has a member with a ski receiving aperture therethrough. The member has a deformed shape where the aperture can slidably fit over a tail end of the ski to a position rearwards of a binding on the ski. The member is resiliently biased away from the deformed shape towards a second shape where portions of the member about the aperture grip the ski to resist sliding of the device from the position towards the tail end of the ski. The member has a part projecting below the ski when the device is in the position. This part is shaped to project into snow below the ski.

9 Claims, 4 Drawing Figures

FIG. 1
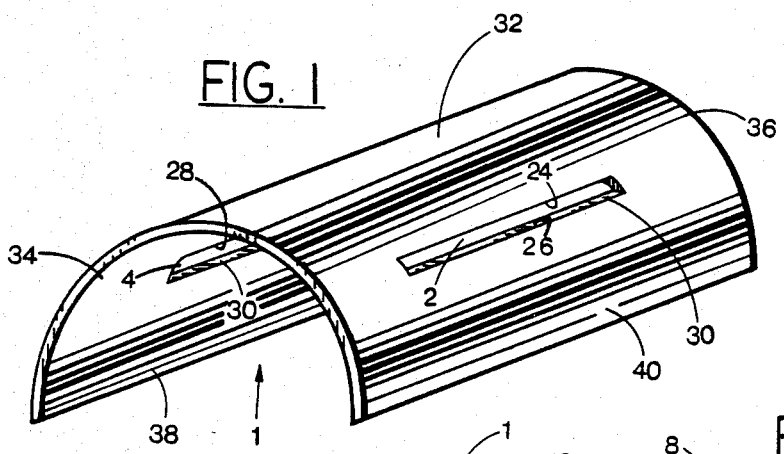
FIG. 2
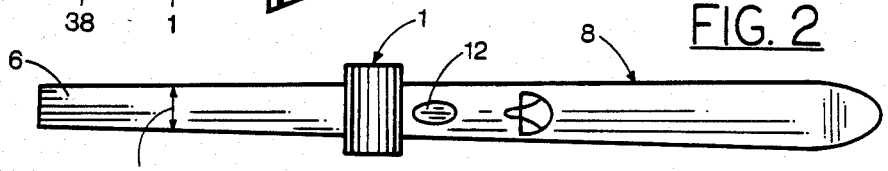
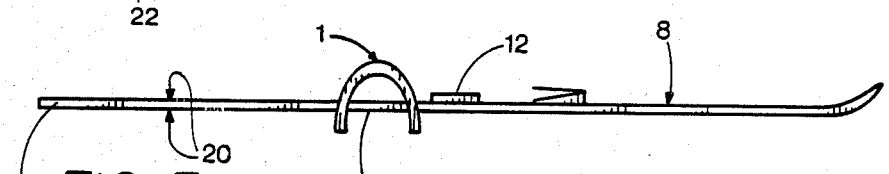
FIG. 3
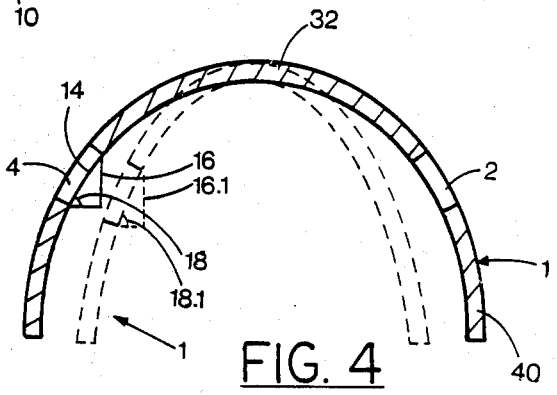
FIG. 4

CLIMBING DEVICE FOR SKIS

BACKGROUND OF THE INVENTION

Field of the Invention

This invention relates to a climbing device for skis having an aperture for receiving a ski.

Snow skiers sometimes have occasion to travel uphill on their skis. This occurs relatively frequently with nordic skiing, otherwise known as cross-country skiing. For relatively gentle slopes nordic skiers employ wax on the base of the ski or special waxless bases normally having a plurality of ridges on the surface or Mohair strips. These means are sometimes inadequate, particularly for climbing steeper slopes as are encountered in mountain touring. For these conditions, both nordic skiers and alpine skiers frequently use climbing skins. These skins are mohair strips running the length of the ski and are attached to the ski by a special adhesive or by hardware. Both types of climbing skins have their disadvantages, particularly the inconvenience of removing them for downhill runs and then reapplying the skins for uphill climbs. In addition, the skins are expensive and not particularly easy to carry. On extremely steep slopes, particularly with some snow conditions, backwards slipping is encountered even with climbing skins.

A number of alternative climbing devices are disclosed in U.S. Pat. Nos. 4,095,813 to Hall, 2,595,586 to LaPointe, 1,989,377 to Osborn, 2,358,213 to Courage, and 2,838,318 to Marshall. Other devices are shown in German Patent No. 183,738 and in Swiss patent No. 171,411. Many of these devices offer certain disadvantages which have prevented widespread adoption of any of these devices. For example, some of these devices would be difficult or time consuming to install. Otherwise, the installation may be difficult, particularly in cold weather using gloved hands. Some of the devices are complicated and relatively expensive, while others are largely ineffective or unreliable.

U.S. Pat. No. 3,495,568 to Palfor may be considered relevant for the manner in which the tab with holes is slid over or attached to the antenna.

SUMMARY OF THE INVENTION

According to the invention, a climbing device for skis comprises a member with a ski receiving aperture therethrough. The member has a deformed shape where the aperture can slidably fit over a tail end of the ski to a position rearwards of a binding on the ski. The member is resiliently biased away from the deformed shape towards a second shape where portions of the member about the aperture grip the ski to resist sliding of the device from said position towards the tail end of the ski. The member has a part projecting below the ski when the device is in said position. The part is shaped to project into snow below the ski.

In a preferred form, the member has two of the apertures. The apertures are sufficiently aligned in the deformed shape to permit the slidable fit. The apertures are insufficiently aligned in the second shape to permit the slidable fit.

The member may be arch shaped with two legs. The part of the member comprises bottom parts of the legs. The apertures extend through the legs above the bottom parts.

BRIEF DESCRIPTION OF THE DRAWINGS

In the drawings,

FIG. 1 is a perspective view of a climbing device for skis according to an embodiment of the invention;

FIG. 2 is a top plan of the device fitted into a position rearwardly of a binding on a ski;

FIG. 3 is a side view of the device and ski of FIG. 2; and

FIG. 4 is a side view of the device of FIG. 1 showing the device in an undeformed shape in solid lines and in a deformed shape in broken lines.

DESCRIPTION OF THE PREFERRED EMBODIMENTS

The drawings show a climbing device 1 for skis. The preferred form shown in the drawings is arch shaped and is made of a stiff, resilient plastic material such as polyethylene or nylon. The device has a pair of apertures 2 and 4 which provide means for connecting a ski to the device. Each of the apertures is dimensioned so it can fit slidably over a tail end 6 of a ski 8 to a position 10 rearwards of a binding 12 on the ski as shown in FIGS. 2 and 3.

FIG. 4 illustrates in solid lines the device in an undeflected shape. In other words, this shows the device in its normal shape unstressed by external forces. It may be seen that the apertures 2 and 4 are misaligned. By this, it is meant that a relatively elongated object with a cross section slightly smaller than that of the apertures cannot freely slide through both apertures at the same time. For example, a ski inserted into aperture 4 would tend to slope downwardly to the right from the point of view of FIG. 4. On the other hand, a ski inserted through aperture 2 would tend to slope downwardly towards the left. A ski that would pass through both apertures as shown in FIG. 3 would be necessarily horizontal and therefore cannot slide freely between the apertures if the ski has a thickness greater than the vertical projection of apertures 2 and 4. This vertical projection 16 of aperture 4, for example, may be seen to be equal to the depth 14 of aperture 4 multiplied by the sin of angle 18. The depth 14 and angle 18 are such that the vertical projection 16 is less than the thickness of the ski represented by the arrows 20 in FIG. 3. In fact, the vertical projection 16 is less than the thickness of a wide spectrum of skis so that device 1 is adaptable to a wide variety of nordic and alpine skis. Aperture 2 is similar in shape and orientation to aperture 4 and is located on the opposite side of the device. As may be seen in FIG. 1, the apertures are rectangular in shape and are elongate in a direction which extends laterally across the ski 8 when the member is in position as shown in FIGS. 2 and 3. The lateral direction of the ski is indicated by arrows 22 FIG. 2. Aperture 2 is bounded by a top edge 24 and a bottom edge 26. Similarly, aperture 4 is bounded by a top edge 28 and a bottom edge 30.

As may be appreciated from FIGS. 1 and 4, the device is substantially arch shaped with an outer surface 32 which is convex in a dimension which extends in the longitudinal direction of the ski when the member is in position as shown in FIG. 2 and 3. The device may be seen as having two legs 34 and 36, the apertures 4 and 2 being located in the two legs respectively. The legs 34 and 36 have bottom parts 38 and 40 respectively below the apertures. These parts are flange-like and are elongate in a direction which extends laterally across the ski when the device is in position as shown in FIGS. 2 and 3. Bottom parts 38 and 40 project below the ski as shown best in FIG. 3 and are shaped to project into snow below the ski. Both parts therefore present a flat flange-like projection into the snow.

The device is designed to fit slidably over the tail end 6 of the ski towards the position 10 when the device is in the deformed shape shown by the broken lines in FIG. 4. In this sense "fit slidably" means a fit sufficiently loose to permit relatively free sliding with little friction. This deformed shape is typically achieved by squeezing the legs 34 and 36 together using the fingers. Although the depth 14 of each of the apertures remains the same, the angle 18 has increased to an angle 18.1. Accordingly, the vertical projection 16.1 has increased so that the vertical projection is then greater than the thickness of the ski. The tail end of the ski then slidably fits simultaneously through apertures 2 and 4 until the device is in the position 10 shown in FIGS. 2 and 3.

Once the device is in position, the fingers are removed and the device, being resiliently biased to the undeformed shape shown in solid lines of FIG. 4, moves to the shape shown in FIG. 3. This shape is not equivalent to the undeformed shape because the ski passing through the apertures prevents the device from resuming the undeformed shape. However, the device has a tendency to resume the undeformed shape. This causes the top and bottom edges of the device about the apertures to grip the ski to resist sliding of the device from the position towards the tail end of the ski. In other words, when the device is in the shape shown in FIG. 3, the apertures are insufficiently aligned to permit a slidable fit. The device can, of course, be removed by pushing it rearwardly over the ski, but a significant force is required here. The resistance is sufficient to prevent accidental sliding of the device off of the ski. This resistance is due to the fact that the device is resiliently biased towards to the undeformed shape shown is solid lines FIG. 4 where the outer surface 32 is less convex than the shape of the outer surface when the device is on the ski as shown in FIG. 3.

It should be appreciated that apertures 2 and 4 may be substantially longer than the lateral dimension 22 of the ski. This permits the device to be fitted onto wider skis.

The skier can easily remove the device from each ski for a downhill run simply by squeezing together bottom parts 38 and 40 which extend below the base of the ski. The device is then pulled towards the tail of the ski and removed, If desired, straps or the like could be employed to hold the device securely on the ski. However, this is not required as shown in the preferred embodiment because the major forces applied to the device when the skier is climbing uphill tend to push the device towards the binding 12 which prevents further movement.

It should be understood that the scope of the invention is not limited by the description of the preferred embodiments, but is set forth in the following claims.

What is claimed is:

1. A climbing device for a ski comprising a member with two ski receiving apertures therethrough, the member having a deformed shape where the apertures are sufficiently aligned to permit the member to slidably fit over a tail end of the ski to a position rearwards of a binding on the ski, the member being resiliently biased away from the deformed shape towards a second shape where the apertures are insufficiently aligned to permit the slidable fit and portions of the member about the aperture grip the ski to resist sliding of the device from said position towards the tail end of the ski, the member having a part projecting below the ski when the device is in said position, the part being shaped to project into snow below the ski.

2. A climbing device as claimed in claim 1 wherein the part is flange-like and elongated in a direction which extends laterally across the ski when the member is in said position.

3. A climbing device as claimed in claim 1, wherein the member comprises a resilient plastic material.

4. A climbing device as claimed in claim 1, wherein the member is arch shaped with two legs, the part of the member comprising bottom parts of the legs, the apertures extending through the legs above the bottom parts.

5. A climbing device as claimed in claim 4, wherein the legs of the member are resiliently movable towards each other to achieve said deformed shape of the member.

6. A climbing device as claimed in claim 1, wherein the member is of a stiff, resilient plastic material.

7. A climbing device as claimed in claim 4, wherein the apertures are substantially rectangular.

8. A climbing device as claimed in claim 4, wherein the member has an outer surface which is convex in a longitudinal direction of the ski when the member is in said position, the member being resiliently biased towards a shape where the outer surface is less convex.

9. A climbing device as claimed in claim 2, wherein the portions are top and bottom edges of the apertures.

* * * * *